US006739244B1

(12) United States Patent
Carbaugh

(10) Patent No.: US 6,739,244 B1
(45) Date of Patent: May 25, 2004

(54) PUNCH AND EMBOSS TOOL WITH INTERCHANGEABLE DIES

(75) Inventor: Jason D. Carbaugh, Woodinville, WA (US)

(73) Assignee: Prestocraft Co., Woodinville, WA (US)

( * ) Notice: Subject to any disclaimer, the term of this patent is extended or adjusted under 35 U.S.C. 154(b) by 2 days.

(21) Appl. No.: 10/102,067

(22) Filed: Mar. 19, 2002

(51) Int. Cl.[7] ..... B26F 1/14

(52) U.S. Cl. ..... 101/3.1; 101/28; 400/134.4; 83/684; 83/685; 30/358; 30/363

(58) Field of Search ..... 101/31, 28, 31.1; 30/358, 362, 363; 83/684, 685, 588, 698.91; 400/127, 129, 132, 133, 134, 134.2, 134.4

(56) References Cited

U.S. PATENT DOCUMENTS

| | | | | |
|---|---|---|---|---|
| 173,732 | A | | 2/1876 | Matthews |
| 475,549 | A | | 5/1892 | Firnstein |
| 507,674 | A | | 10/1893 | Connell et al. |
| 521,358 | A | | 6/1894 | Backus |
| 622,987 | A | | 4/1899 | Wagner |
| 685,212 | A | | 10/1901 | Knowlton |
| 1,375,721 | A | | 4/1921 | Nichols |
| 1,428,174 | A | | 9/1922 | Luther |
| 1,491,464 | A | | 4/1924 | Coomer |
| 1,780,715 | A | | 11/1930 | Olson et al. |
| 2,005,340 | A | | 6/1935 | Jaffin et al. |
| 2,589,849 | A | | 3/1952 | Oetiker |
| 2,808,108 | A | | 10/1957 | Pellegrino |
| 2,906,197 | A | | 9/1959 | Priesmeyer |
| 3,073,199 | A | | 1/1963 | Yerkes |
| 3,111,053 | A | | 11/1963 | Svensson |
| 3,230,812 | A | | 1/1966 | Pucci et al. |
| 3,260,192 | A | | 7/1966 | Ostenberg |
| 4,267,753 | A | | 5/1981 | Bennett |
| 4,574,693 | A | | 3/1986 | Fink et al. |
| 4,594,927 | A | | 6/1986 | Mori |
| 4,713,995 | A | | 12/1987 | Davi |
| 5,025,691 | A | * | 6/1991 | Deni ..... 83/140 |
| 5,067,242 | A | | 11/1991 | Singer |
| 5,181,464 | A | | 1/1993 | Kuhlman et al. |
| 5,243,887 | A | | 9/1993 | Bonge, Jr. |
| 5,247,863 | A | | 9/1993 | Cohen |
| 5,255,587 | A | | 10/1993 | Eichenberg et al. |
| D364,411 | S | | 11/1995 | Wang |
| 5,495,671 | A | | 3/1996 | Shun-Yi |
| 5,601,006 | A | | 2/1997 | Quinn et al. |
| 5,647,278 | A | | 7/1997 | Wu |
| 5,660,105 | A | | 8/1997 | Benson et al. |
| 5,697,278 | A | | 12/1997 | Shun-Yi |
| D394,080 | S | | 5/1998 | Chan |
| 5,749,278 | A | | 5/1998 | Lee et al. |
| 5,893,313 | A | | 4/1999 | Mori |
| 5,967,786 | A | | 10/1999 | Wang |
| 5,993,090 | A | | 11/1999 | Straka et al. |

(List continued on next page.)

OTHER PUBLICATIONS

Attached Sheets 1, 2, 3, 4, and 5.

*Primary Examiner*—Andrew H. Hirshfeld
*Assistant Examiner*—Kevin D. Williams
(74) *Attorney, Agent, or Firm*—Davis Wright Tremaine LLP

(57) ABSTRACT

A punch/emboss tool is provided that accepts interchangeable insert sets. A punch insert set consists of one punch and one die that cooperate to punch out a particular design in sheet material, such as paper. Similarly, an emboss insert set consists of one emboss die and one emboss die counter that cooperate to emboss a particular design. Once loaded in the tool, one half of the insert set is fixed relative to the tool. The other half is slidably aligned to the first half by a non-circular bore. The sheet material is inserted into a slit in the tool, between the two cooperating inserts. An actuating lever presses on the sliding half of the insert set with some mechanical advantage to the user. When a user presses the actuating lever, the two halves of the aligned insert set cooperate to form a punched or embossed design on the sheet material.

6 Claims, 8 Drawing Sheets

U.S. PATENT DOCUMENTS

| | | | |
|---|---|---|---|
| 6,000,139 | A | 12/1999 | Chan |
| 6,027,773 | A | 2/2000 | Sterr et al. |
| 6,076,447 | A | 6/2000 | Damask |
| 6,089,137 | A | 7/2000 | Lee |
| 6,145,425 | A | 11/2000 | Bonnar et al. |
| 6,189,220 | B1 | 2/2001 | Chen |
| 6,209,434 | B1 | 4/2001 | Kim et al. |
| 6,219,925 | B1 | 4/2001 | Chen |
| 6,260,459 | B1 | 7/2001 | Peterson |
| 6,312,310 | B1 | 11/2001 | Sterr et al. |
| 6,324,954 | B1 | 12/2001 | Chen |
| 2002/0083815 | A1 * | 7/2002 | Whiteman et al. ..... 83/698.91 |

* cited by examiner

PUNCH AND EMBOSS TOOL WITH INTERCHANGEABLE DIES

FIELD OF THE INVENTION

The present invention relates to a tool for punching and embossing a variety of designs in a sheet of material, such as paper. More particularly, the present invention is a hand-operated punch/emboss tool with economical interchangeable dies that are orientable in a variety of directions with respect to the punch/emboss tool.

BACKGROUND OF THE INVENTION

A variety of punch and emboss tools are available for punching and embossing designs in sheets of material, such as paper. Most of these punch and emboss tools have a significantly limited reach and a fixed design orientation, and thus impose a restriction on the location and orientation of the punched or embossed image on common sizes of paper, such as 8½"×11". As such, users must often punch or emboss smaller sheets, and adhere them to a larger sheet in the desired, but unreachable, location and orientation. Some long reach tools with orientable patterns exist, but they are usually limited to punching or embossing a single design. A user must invest in a whole new tool in order to have a new punch or emboss design with the same freedom of reach and orientability. A user therefore may begin to acquire a collection of individual punch tools and emboss tools that is not only expensive, but bulky to carry. The few tools that have interchangeable punch or emboss inserts are implemented such that the reach and orientability benefits are sacrificed, or such that the interchangeable inserts are relatively complex and costly.

Another common drawback of many punch tools is that they are difficult to actuate, causing excessive repetitive physical stain to the user. Therefore, tools that do not themselves include a means of providing the user with extra mechanical advantage are often actuated with an additional leverage mechanism, which again adds to a user's cost.

Therefore, it is an objective of this invention to provide a single tool that will allow a user to punch or emboss a variety of designs on common sizes of sheet material such as paper, at any location on the sheet, in a variety of orientations.

It is a further object of this invention to provide interchangeable punch inserts and emboss inserts that are relatively inexpensive, so that it is economical to take advantage of the benefits of the tool for additional punch or emboss designs.

It is a further object of this invention to provide interchangeable punch inserts and emboss insets that are compact, such that it is easy to carry a collection of them.

It is a further object of this invention to provide a built-in means of leverage so that the user can actuate the punching inserts without excessive physical force or external leverage mechanisms.

SUMMARY OF THE INVENTION

The invention is an improved punch/emboss tool. The tool has a frame with two elongated beams. The upper beam is joined at one end to the lower beam and extends in a parallel and spaced-apart fashion so that a sheet of paper, or the like, can be slipped in between the two beams. The ends of the beams define two "bore" portions for carrying either a punch set or an emboss set. A person in the arts and crafts industry would understand that punch and emboss sets work in much the same way, mechanically, the significant difference being that a "punch" set is used to punch a decorative hole in a piece of paper and an "emboss" set is used to emboss a decorative design in the paper.

Each of the two portions of the frame making up the bore portions are shaped to interchangeably hold one part of a two-part punch/emboss set. In other words, each frame portion holds one separate part (or one-half) of the set in a manner such that it is easy to replace one set (having a particular punch or emboss pattern) with another. An aspect of the invention that sets it apart from the prior art is that one of the two frame portions allows the part of the set that it holds to co-axially slide toward and away from the other part of the set. This enables the parts of the set to be driven together into engagement with a sheet of paper (or similar sheet of material) between them.

In preferred form, the bore portions described above are constructed as square bores in which each separated part of the punch/emboss set resides. The two bores are fixed by the frame such that the two halves of the insert set are registered in coaxial alignment. Their non-circular shape prevents one part of the punch/emboss set from rotating relative to the other to ensure precise registration of the parts of the set when they come together. While the bores are described here as being square in shape, it is to be understood that other polygonal shapes or other non-circular shapes may work just as well. An advantage to using a radially symmetrical bore shape is that the insert sets can be releasably loaded in multiple orientations, thus allowing further flexibility in the placement of the punched or embossed image on a sheet of material. For example, a square bore allows the insert set to be loaded in one of four possible orientations.

The upper frame of the tool carries a lever arm pivotally connected to the frame for driving one of the parts of the set into engagement with the other, when manipulated by the user. The lever arm has a lobe portion that extends into the recess or opening defined by the square bore of the upper frame, for pushing its respective one-half of the punch/emboss set toward the other half that is held in the lower part of the frame. The lever arm is positioned at or near the end of the upper beam.

The frame beams are sufficiently long so that the interchangeable insert set can reach the middle of a conventional sheet of paper for punching or embossing a design in it.

A preferred embodiment of the invention is described below in detail. In the past, a person practicing arts and crafts needed to purchase separate punch/emboss tools to create separate designs in paper. While some prior art tools have interchangeable cartridges that allow the same tool to be used to make different designs, none provide such easy interchangeability, orientability, and the capability of reaching to the center of a sheet of paper.

DETAILED DESCRIPTION OF THE PREFERRED EMBODIMENT

Figure 1:
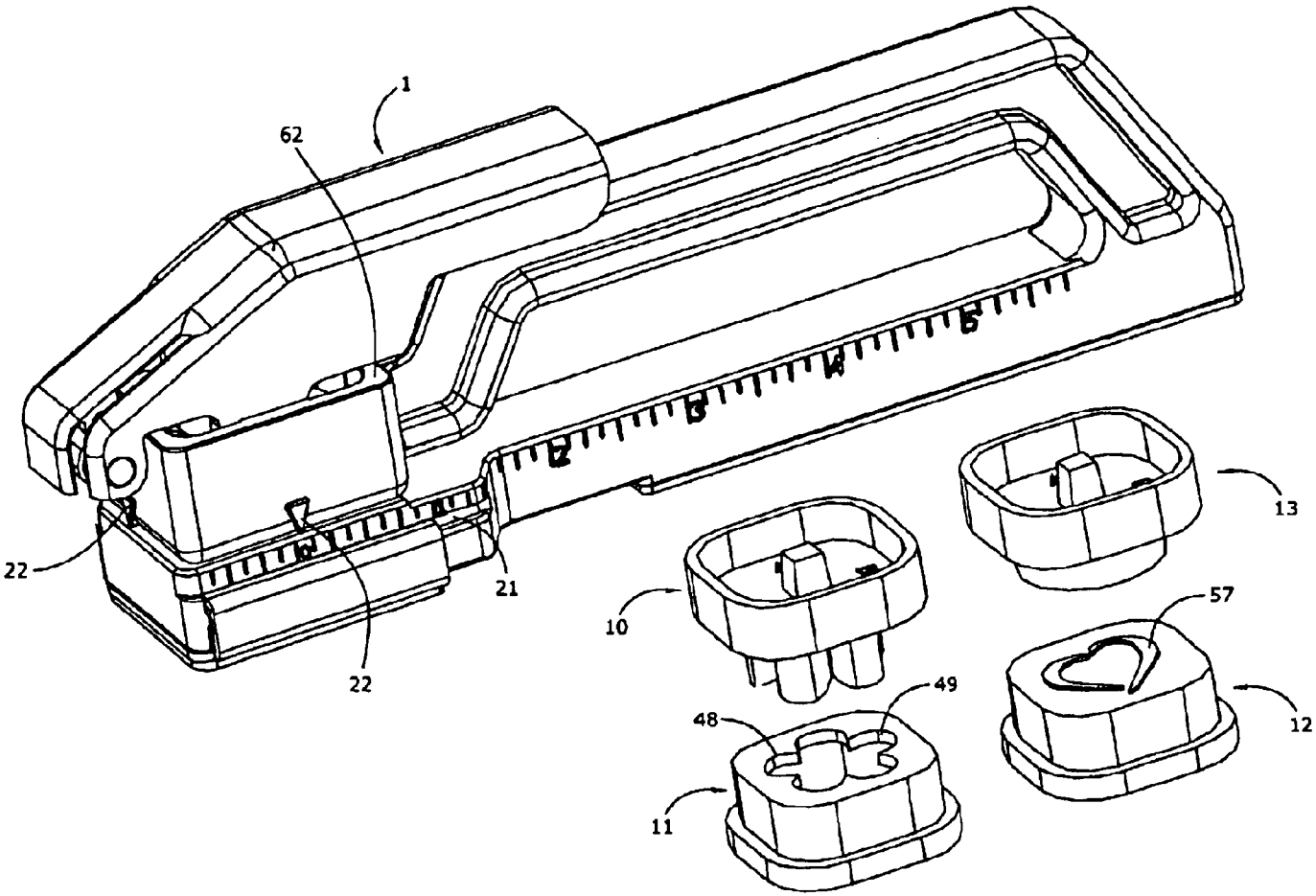
FIG. 1 is a top perspective view of a preferred embodiment of a punch/emboss tool, along with a punch, punching die, embossing die, and embossing die counter in accordance with the present invention.
Figure 2:
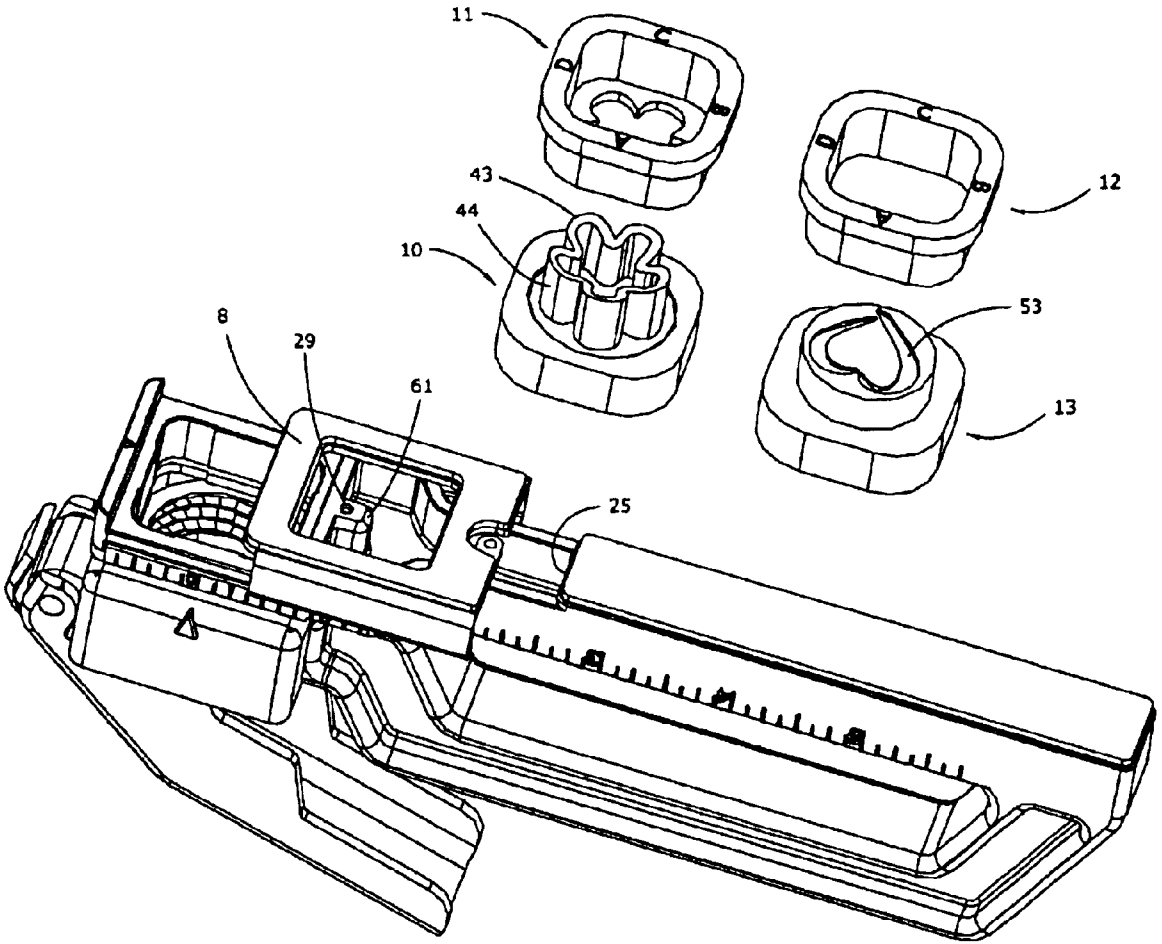
FIG. 2 is a bottom perspective view of the punch/emboss tool and dies in FIG. 1.
Figure 3:
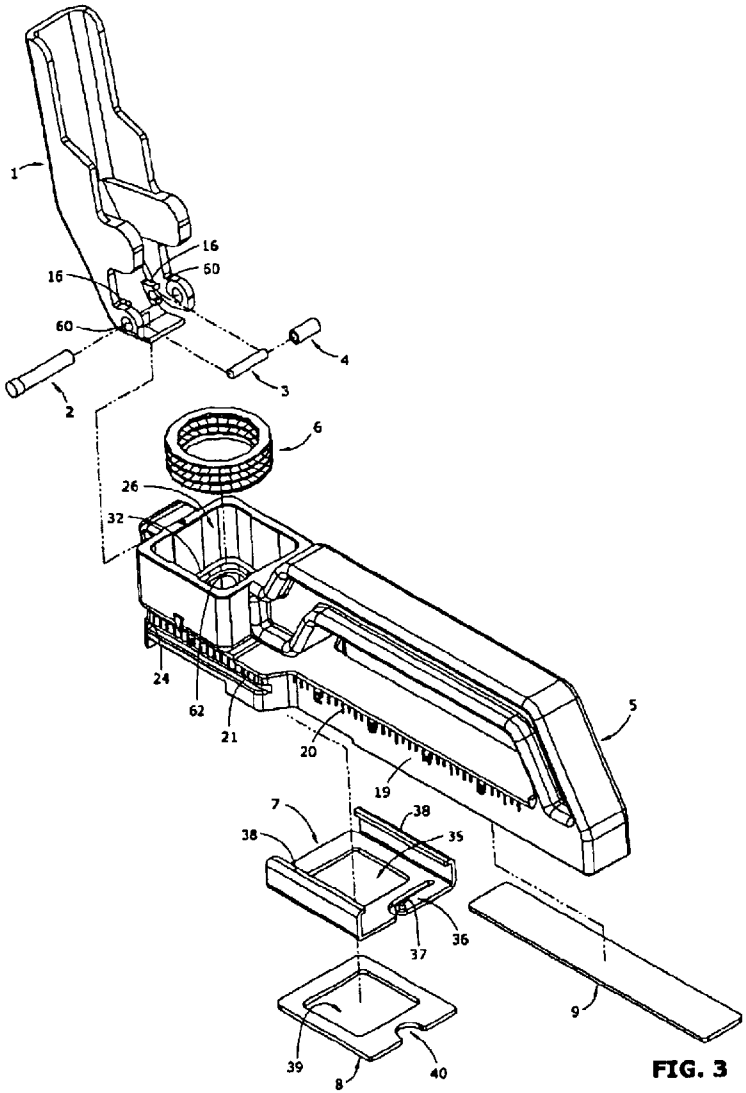
FIG. 3 is an exploded perspective view of the punch/emboss tool in FIG. 1.

Referring to FIGS. 1–3, a punch/emboss tool in accordance with the present invention generally includes a frame or body 5, a lever 1, a hinge pin 2, a trapdoor 7, a return spring 6, a roller pin 3, a roller sleeve 4, a front foot 8, and a rear foot 9. A punch 10, and a punching die 11 are used with the tool to punch out a decorative shape from a sheet of material, such as paper. Alternatively, an embossing die 13 (one part of the set) and an embossing die counter 12 (a second part of the set) are used with the tool to emboss a decorative shape onto a sheet of material, such as paper.

The lever 1 is pivotally attached to the body 5 by the hinge pin 2. The hinge pin 2 is held in place axially by a press fit between the ends of the hinge pin 2 and the hinge pin holes 60 in the lever 1.

The roller sleeve 4 is slid axially over the roller pin 3 so that the ends of the roller pin 3 protrude from the ends of the roller sleeve 4. The ends of the roller pin 3 are then placed in the yokes 16 of the lever 1. The yokes 16 are then deformed such that the roller pin 3 is rigidly fixed to the lever 1 without rolling or sliding axially. The roller sleeve 4 is then free to rotate freely over the roller pin 3, but is constrained axially to remain between the two yokes 16.

The bottom of the return spring 6 rests on the lip 32 at the bottom of the upper square bore 26 of the body 5. The return spring 6 and the upper square bore 26 are assembled such that they are coaxial.

The trapdoor 7 is slidably attached to the lower beam 19 of the body 5. The guide lips 38 of the trapdoor 7 slide within the guide slots 21 of the lower beam 19. The trapdoor 7 is free to slide back and forth along the guide slots 21 between the front trapdoor stop 24 and rear trapdoor stop 25. As the user slides the trapdoor 7 toward the front trapdoor stop 24, the end of the leafspring 36 with the detent 37 is deflected away from the body 5 by the ramp 61. As the trapdoor 7 reaches the front trapdoor stop 24, the detent engages the indent 29. Thus, the trapdoor 7 is held in place so that it can no longer freely slide in the guide slots 21. To slide the trapdoor 7 back again toward the rear trapdoor stop 25, a user grips the sides of the trapdoor 7 and pulls rearward. The rim of the indent 29 is chamfered so that the rearward pull results in an outward force on the detent 37, causing it to disengage. A continuing rearward pull drags the detent 37 backward off the ramp 61, thereby allowing the trapdoor 7 once again to slide freely in the guide slots 21.

The initial assembly of the trapdoor 7 onto the body 5 is accomplished by placing the front end of the guide lips 38 into the rear end of the guide slots 21, with the rear end of the trapdoor 7 angled outward over the rear trapdoor stop 25. Upon forcing the trapdoor 7 forward, the compliance of the leaf spring 36 and the trapdoor 7 in general allows the rear edge of the trapdoor 7 to drag forward past the rear trapdoor stop 25. The trapdoor 7 is then captive between the front trapdoor stop 24 and the rear trapdoor stop 25.

The front foot 8 is adhesively attached to the trapdoor 7. The front foot window 39 and the trap door window 35 are aligned such that a piece of punched-out sheet material can fall through them. The relief 40 allows the user to see the underside of the detent 37 to verify when it is engaged with the indent 29. The relief 40 also prevents the flexing of the leafspring 36 from tearing the front foot 8 away from the trapdoor 7. The rear foot 9 is adhesively attached to the underside of the body 5. The front foot 8 and the rear foot 9 give the punch/emboss tool a non-skid bottom surface that also will not mar a table top or other surface upon which it rests.

Figure 4:
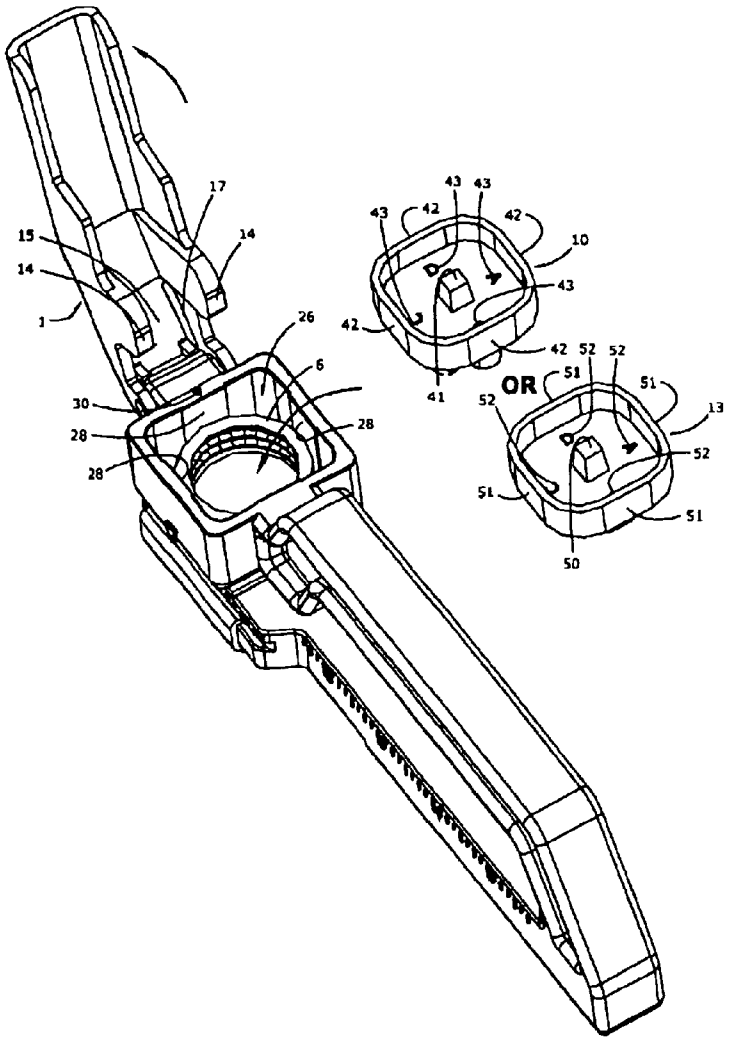
FIG. 4 is a top perspective view of the punch/emboss tool in FIG. 1 with the lever lifted to insert a punch or embossing die.
Figure 6:
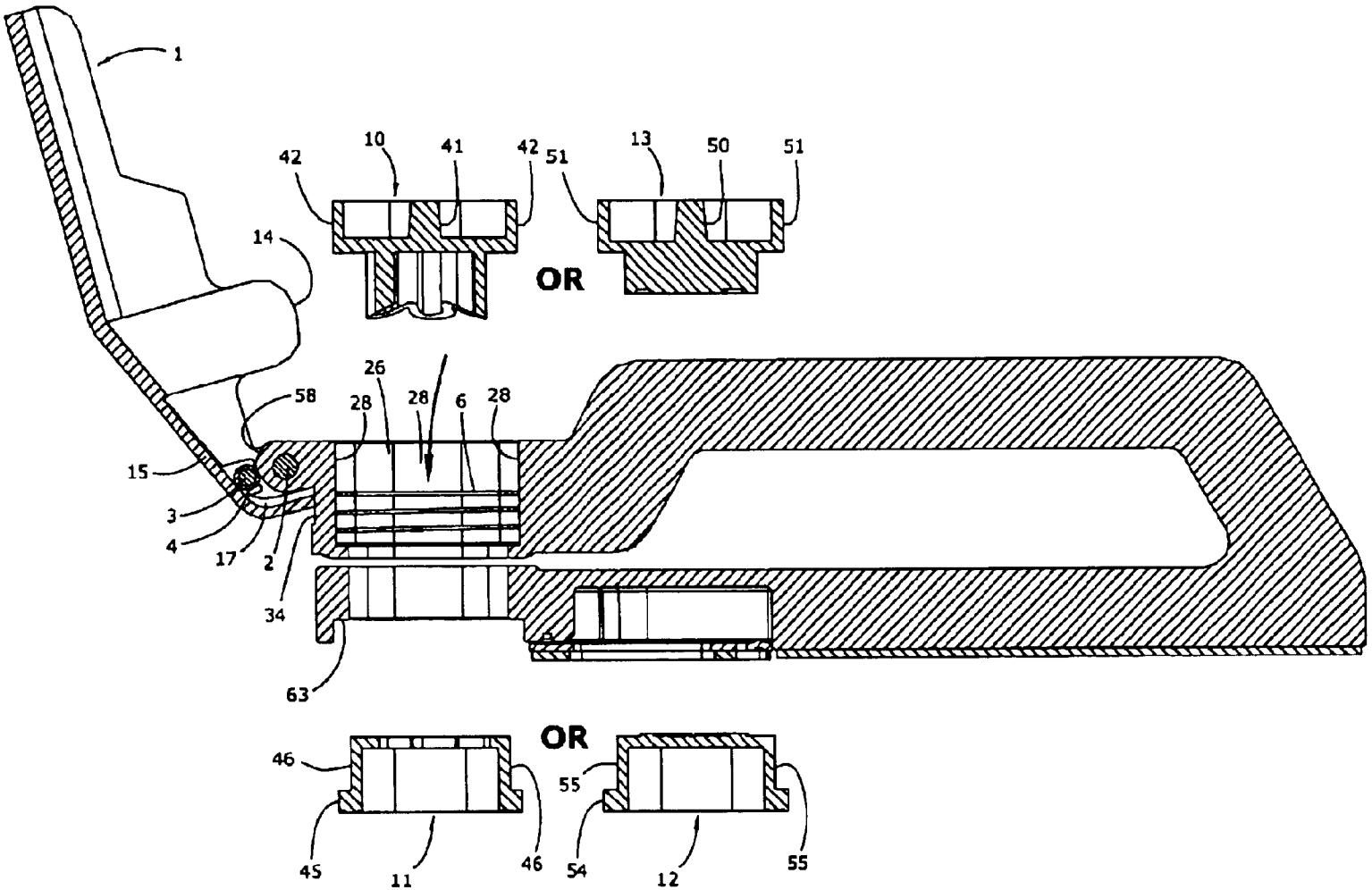
FIG. 6 is a cross-sectional side view of the punch/emboss tool in FIG. 1 with the lever lifted and the trapdoor retracted to insert or remove the punch and punching die.

Referring to FIGS. 4 and 6, the user must lift the lever 1 to its fully open position in order to releasably load a punch 10 or an embossing die 13 into the upper square bore 26. As the lever 1 begins to be lifted upward, it rotates about the hinge pin 2. The roller sleeve 4 soon contacts the cam 58 and begins to turn on the roller pin 3. As the upward rotation of the lever 1 continues, the cam 58 forces the roller sleeve 4 and the roller pin 3 away from the hinge pin 2. This outward force causes the flexing beam 15 between the two slits 17 to elastically bend slightly outward, thus providing a small restoring force that resists the upward rotation of the lever 1. As the user continues to lift the lever 1 against this small restoring force, the roller sleeve 4 reaches the peak of the cam 58. A snapping action takes place as the restoring force provided by the flexing beam 15 now tends to lift the lever 1 instead of resisting the lift. The lever 1 then continues to rotate upward on its own as the cam 58 allows the flexing beam 15 to relax. The upward rotation of the lever 1 stops at the fully open position when the end of the flexing beam 15 reaches the upward lever stop surface 34. The cam 58 is shaped such that the flexing beam 15 is not quite fully relaxed at this position, thus providing a preload that biases the lever 1 to remain in the fully open position. This preload prevents the lever 1 from snapping shut on the user's hand, even if the lever 1 is inadvertently nudged toward the closed position.

With the lever 1 fully open, the user holds a punch 10 by the grip 41, and places it into the upper square bore 26 in the user's desired orientation. The orientation is displayed from the top of the punch 10 by the orienting letter 43 that is closest to the upper orienting arrow 30. The upper locating surfaces 28 slidably register the punch locating surfaces 42 so that the punch 10 is precisely coaxial with the upper square bore 26. The punch 10 slides down the upper square bore 26 until it comes to rest on the upper surface of the return spring 6.

Alternatively, the user holds an embossing die 13 by the grip 50, and places it into the upper square bore 26 in the user's desired orientation. The orientation is displayed from the top of the embossing die 13 by the orienting letter 52 that is closest to the upper orienting arrow 30. The upper locating surfaces 28 slidably register the embossing die locating surfaces 51 so that the embossing die 13 is precisely coaxial with the upper square bore 26. The embossing die 13 slides down the square bore 26 until it comes to rest on the upper surface of the return spring 6.

The user then pulls the lever 1 downward until the lobes 14 contact the surface of the punch 10 or embossing die 13. Once the lever 1 is down, the cam 58 prevents the lever 1 from opening, even if the punch/emboss tool is turned upside-down. Thus, the punch 10 or embossing die 13 will not unexpectedly fall out of the upper square bore 26 (upper frame position) during use.

Figure 5:
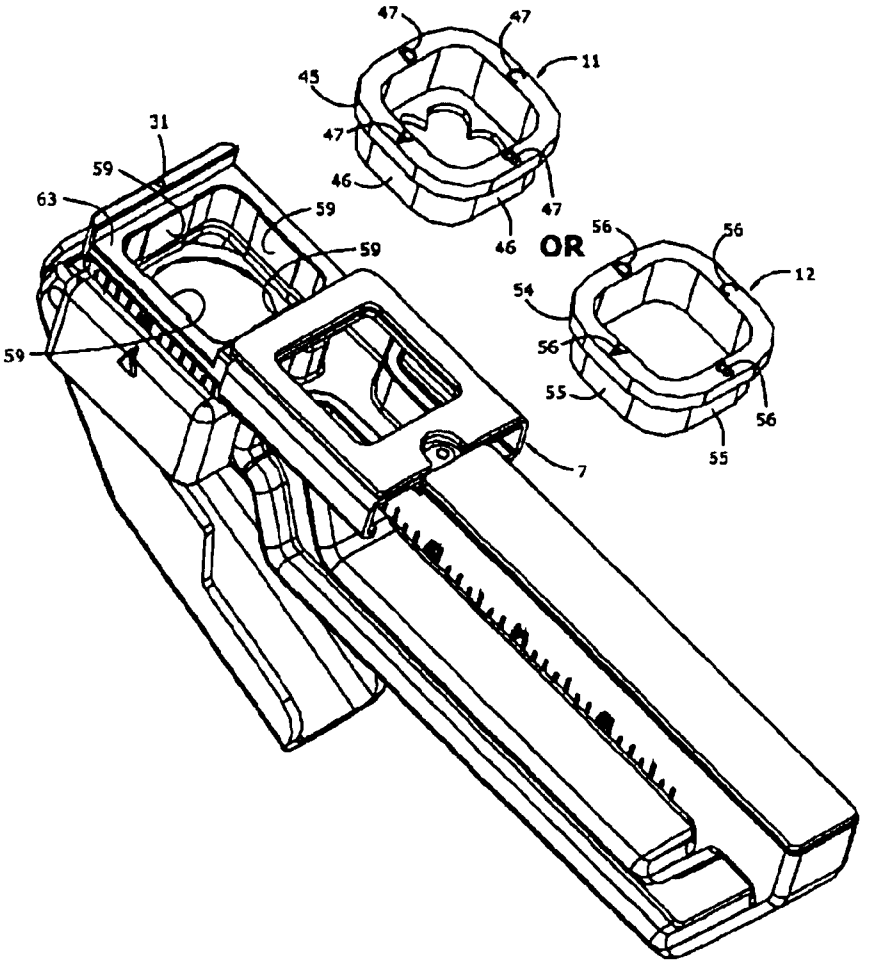
FIG. 5 is a bottom perspective view of the punch/emboss tool in FIG. 1 with the trapdoor retracted to insert a punching die or embossing die counter.

Referring to FIGS. 5 and 6, the user must pull the trapdoor 7 back until it contacts the rear trapdoor stop 25 in order to releasably load or hold a punching die 11 or an embossing die counter 12 into the lower square bore 27 (lower frame position). The lower square bore 27 and the upper square bore 26 are precisely coaxial so that the dies loaded in the bores are aligned. The upper and lower square bores 26, 27 ensure that the dies register or cooperatively mate for respectively punching or embossing a sheet of material when the tool is in use. While the bores are designed to be square in the embodiment described here, they could be made in another polygonal or non-circular shape. There may be other kinds of structural configurations that accomplish the same function.

With the trapdoor 7 fully open, the user holds a punching die 11 by the lip 45, and places it into the lower square bore 27, such that the orienting letter 47 that is nearest the lower orienting arrow 31 matches the orienting letter 43 that is nearest the upper orienting arrow 30. This ensures that the punch 10 and punching die 11 are oriented in the same direction for proper engagement. The lower locating surfaces 59 slidably register the punching die locating surfaces 46 so that the punching die 11 is precisely coaxial with the lower square bore 27. The punching die 11 slides down the lower square bore 27 until the lip 45 comes to rest on the lip stop surface 63.

Alternatively, the user holds an embossing die counter 12 by the lip 54, and places it into the lower square bore 27, such that the orienting letter 56 that is nearest the lower orienting arrow 31 matches the orienting letter 52 that is nearest the upper orienting arrow 30. This ensures that the embossing die 13 and embossing die counter 12 are oriented in the same direction for proper engagement The lower locating surfaces 59 slidably register the embossing die counter locating surfaces 55 so that the embossing die counter 13 is precisely coaxial with the lower square bore 27. The embossing die counter 13 slides down the lower square bore 27 until the lip 54 comes to rest on the lip stop surface 63.

The user then grips the sides of the trapdoor 7 and slides it forward until it reaches the front trapdoor stop 24. Held in place by the engaged detent 37, the trapdoor 7 now holds the punching die 11 or embossing die counter 12 up in the lower square bore 27 when the punch/emboss tool is turned upright for use.

Figure 7A:
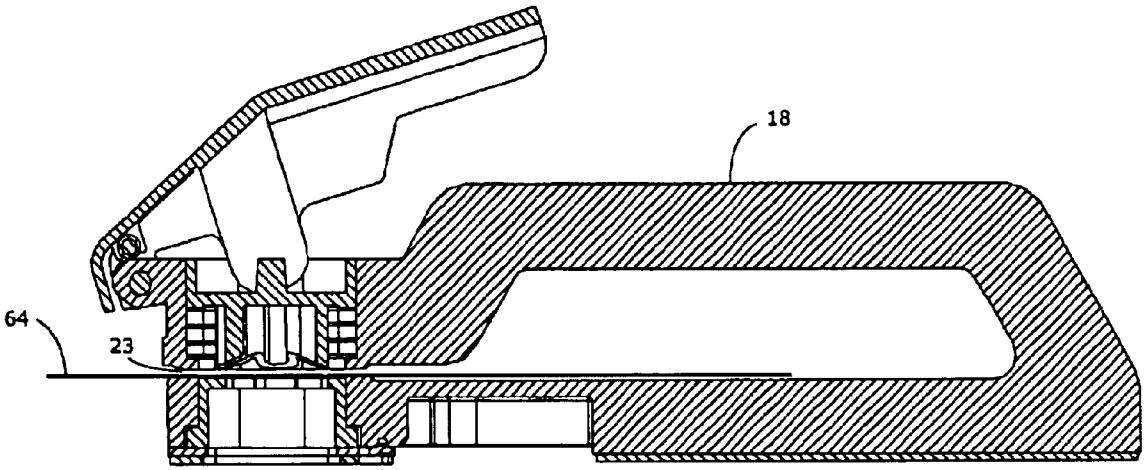
FIG. 7*a* is a cross-sectional side view of the punch/emboss tool in FIG. 1 with a punch and punching die loaded and ready for punching.
Figure 7B:
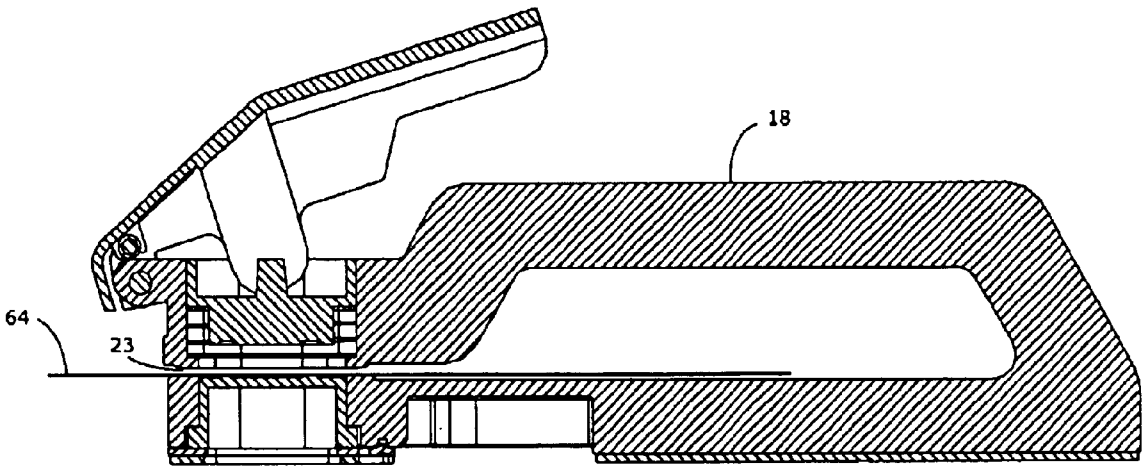
FIG. 7*b* is a cross-sectional side view of the punch/emboss tool in FIG. 1 with an embossing die and embossing die counter loaded and ready for embossing.

Referring to FIGS. 7*a* and 7*b*, the punch/emboss tool is ready for actuation. The user grips the upper beam 18 with one hand, placing the thumb on the back end of the lever 1. The punch/emboss tool can be used in mid-air or while resting on a work surface. With the other hand, the user inserts the sheet material 64 into the gap 23, noting the location of the center of the imminent punched/embossed pattern shown by the centering arrows 22. The ruler markings 20 may be used to measure the distance from the edge of the sheet material 64 to the center of the imminent punched/embossed pattern.

Figure 8A:
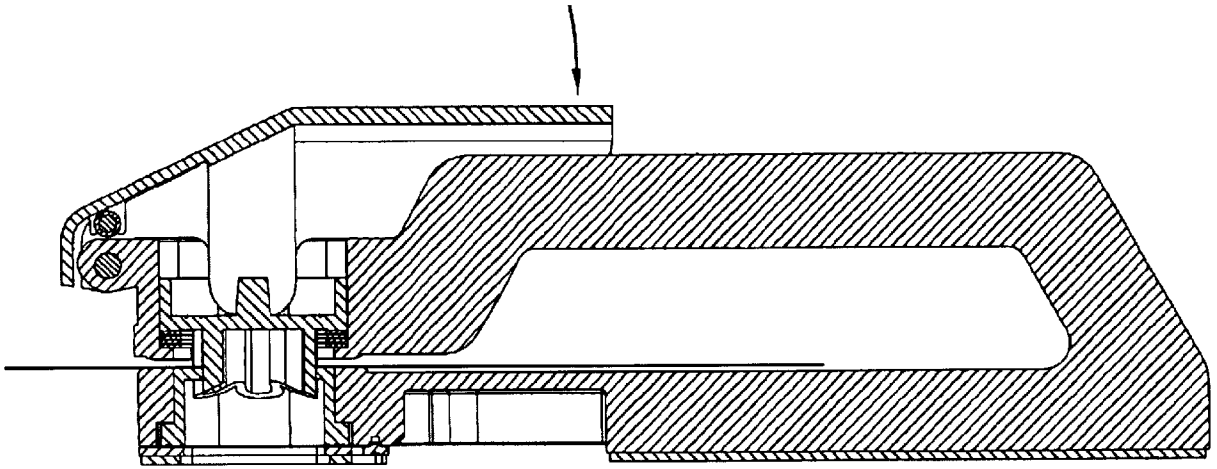
FIG. 8*a* is a cross-sectional side view of the punch/emboss tool in FIG. 1 with the lever depressed, punching a sheet of material.

Referring to FIG. 8*a*, a user punches a decorative shape out of the sheet material 64 by squeezing the lever 1 with the thumb until the lever 1 stops at the downward lever stop surface 62. The punched-out material falls through the trapdoor window 35 and the front foot window 39. Upon releasing the lever 1, the sheet material 64 can be slid out of the gap 23.

Figure 8B:
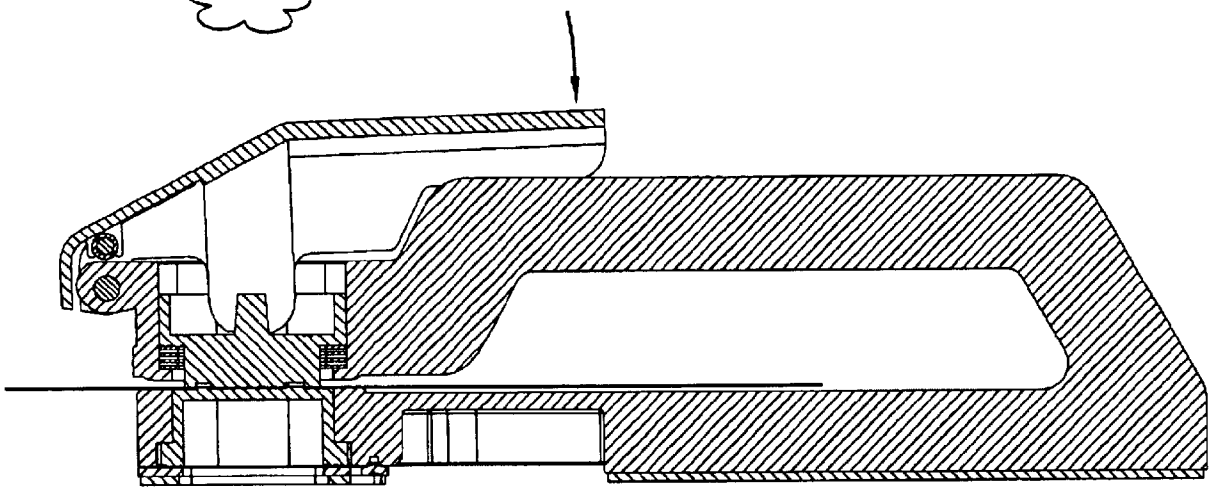
FIG. 8*b* is a cross-sectional side view of the punch/emboss tool in FIG. 1 with the lever depressed, embossing a sheet of material.

Referring to FIG. 8*b*, a user embosses a decorative shape in of the sheet material 64 by squeezing the lever 1 with the thumb, thereby squeezing the sheet material 64 between the embossing die 13 and embossing die counter 12. The lever 1 does not reach the lever stop surface 62 while embossing. Upon releasing the lever 1, the sheet material 64 can be slid out of the gap 23.

The forgoing description sets forth the best mode for carrying out the invention as it is currently known. It is not intended that the description should limit the scope of patent protection in any way. Instead, the spirit and scope of the invention is to be limited by the following patent claim or claims, the interpretation of which is to be made in accordance with the well-established doctrines of patent claim interpretation.

What is claimed is:

1. An improved hand-operated punch/emboss tool, comprising:

a frame defining two bore portions that do not move relative to each other and are shaped to hold an interchangeable insert set, the set including two separated parts that cooperate to either punch or emboss a particular design on a thin sheet of material when they are driven into engagement from opposite sides of the sheet of material, and wherein both bore portions are shaped to releasably hold one part of the set, for easy interchange of one set with another, but in a manner so that one part of the set may be driven co-axially within, and guided by the bores portion in which it resides, toward and away from the other part of the set, and a hand-operated lever rotatably connected to the frame for driving the parts of the set together into engagement, the lever having a portion that is shaped to be in driving contact with one part of the set when the lever is in an operative position, and further, the lever being rotatable connected to the frame in a manner so that the lever can be swung open to allow the part of the set that it drives to be inserted in or removed from its respective bore portion.

2. The improvement of claim 1, wherein each frame bore portion includes a non-circular shape for slidingly mating with an outer surface of one part of the insert set, in a manner so as to prevent axial rotation of each part of the insert set within its respective frame bore portion.

3. The improvement of claim 2, wherein each bore portion has a square shape.

4. The improvement of claim 1, including a spring positioned within one of the bore portions and biased to slide one part of the set away from the other.

5. An improved hand-operated punch/emboss tool, comprising: a frame defining two end portions that do not move relative to each other, the end portions being shaped to hold an interchangeable insert set, the set including two separated parts that cooperate to either punch or emboss a particular design on a thin sheet of material when they are driven into engagement from opposite sides of the sheet of material, and wherein the end portions are shaped to releasably hold the set, in a manner so that one part of the set may be driven and guided by the end portion that holds it, to co-axially slide toward and away from the other part of the set, and further, the two end portions of the frame are supported by upper and lower elongated frame beams, the frame beams being of sufficient length such that the interchangeable insert set can reach the middle of a conventional sheet of paper, and still further, a hand-operated lever rotatably connected to the frame for driving the parts of the set together into engagement, the lever having a portion that is shaped to be in driving contact with one part of the set when the lever is in an operative position, and further, the lever being rotatably connected to the frame in a manner so that the lever can be swung open to allow the part of the set that it drives to be inserted in or removed from its respective end portion.

6. The improvement of claim 5, including a spring arranged relative to one of the end portions and biased to slide one part of the set away from the other.

* * * * *